United States Patent [19]

Kagan

[11] Patent Number: 4,605,191

[45] Date of Patent: Aug. 12, 1986

[54] SUSPENDABLE DISPLAY RECEPTACLE

[76] Inventor: Michael Kagan, 116 Viceroy Rd., Bldg. B, Unit #9, Concord, Ontario, Canada

[21] Appl. No.: 620,084

[22] Filed: Jun. 12, 1984

Related U.S. Application Data

[63] Continuation-in-part of Ser. No. 126,663, Mar. 3, 1980, abandoned.

[51] Int. Cl.[4] ..... A47H 1/10

[52] U.S. Cl. ..... 248/318; 47/67

[58] Field of Search ..... 248/317, 318, 612, 323, 248/327, 328; 217/36 R; 47/35, 67, 39; 220/92, 68, 95, 69; D11/48; 211/113, 128

[56] References Cited

U.S. PATENT DOCUMENTS

| | | | |
|---|---|---|---|
| D. 250,376 | 11/1978 | Schoenbrun | 47/67 X |
| D. 274,583 | 7/1984 | Lafferty | D11/148 |
| 3,419,196 | 12/1968 | Moore | 220/95 X |
| 3,981,099 | 9/1976 | Dziewulski | 47/67 |
| 4,032,102 | 6/1977 | Wolf et al. | 47/67 X |
| 4,063,387 | 12/1977 | Mitchell | 47/67 |
| 4,065,090 | 12/1977 | Mauney | 47/67 X |
| 4,109,415 | 8/1978 | Hall | 211/113 X |
| 4,227,623 | 10/1980 | Woinarski | 220/95 X |
| 4,349,172 | 9/1982 | Banks | 248/318 |

*Primary Examiner*—J. Franklin Foss

*Attorney, Agent, or Firm*—Ivor M. Hughes

[57] ABSTRACT

A display receptacle having a rim and an outer surface and carrying a plurality of tabulate bodies or relatively thin protrusions, each tabulate body or relatively thin protrusion presenting a face on the side of the body remote the surface of the receptacle, proximate its rim, carrying a socket and vertically extending slot, both opening through the face, a wall restricting the opening of the socket and slot through the face to less than their widths, the slot extending to a groove around the body having restricted groove portions so that a filament strand with an enlarged end secured in the socket and passing down the slot and around the tabulate body in the groove is secured to the tabulate body or protrusion in cradle fashion to reduce the tensile stress on the enlarged end. The strands from each body are passed together through an aperture in a hanger ring and melded together to rest on the rim of the aperture on the ring. The strands can be equally adjusted for length from the rim of the receptacle by knotting them together at any desired position above the aperture in the ring.

15 Claims, 4 Drawing Figures

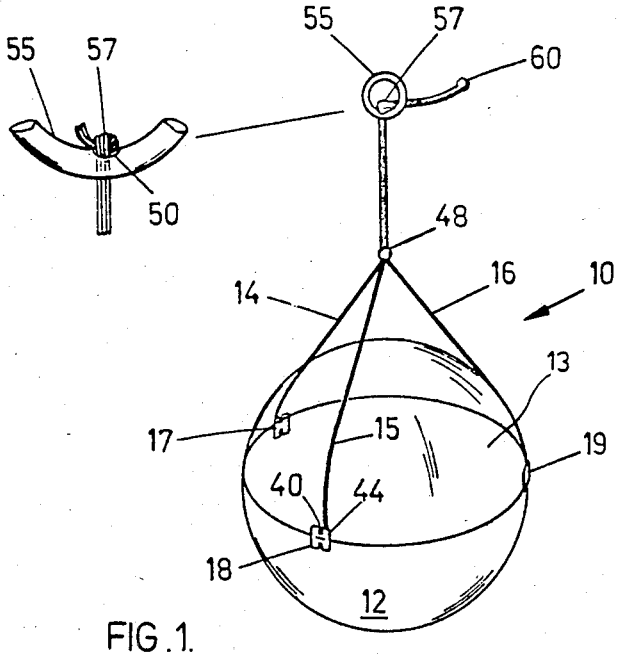
FIG. 1.
FIG. 2
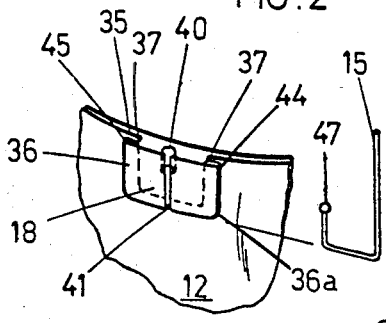
FIG. 3.
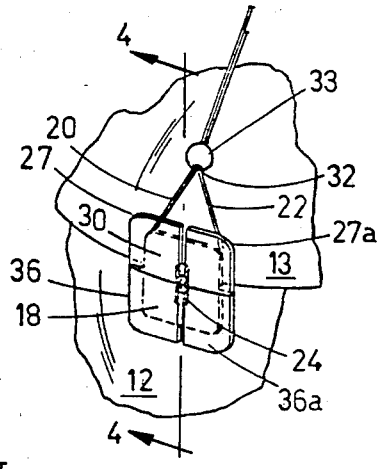
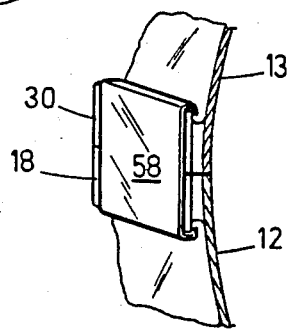
FIG. 4.

SUSPENDABLE DISPLAY RECEPTACLE

This is a continuation-in-part application to U.S. application Ser. No. 126,663, filed Mar. 3, 1980, now abandoned.

FIELD OF INVENTION

The present invention relates to a display receptacle (for example a planter) intended to be suspended from a ceiling or the like, by adjustment of filaments or strands used to suspend the receptacle without the necessity of cutting or drilling into the receptacle for securing the filaments or strands to the receptacle as drilling often causes a crack in the receptacle walls, weakening it.

In particular, the present invention provides, in one embodiment, a display receptacle preferably of clear plastics material such as acrylic, to be suspended by fine extruded monofilament polypropylene strands. The strands are to be held to the rim of the receptacle by enlarged ends (upsets) formed in the end of each strand which each mate with a socket integrally formed in a tabulate body or protrusion provided at the rim of the receptacle, each strand extending from the socket through a slot in the tabulate body which extends down through the body away from the rim opening through the tabulate body, into a groove around the body for receiving the filament and holding it around the body to cradle the strand and ensure that the tension of the suspension is borne by the strand and other such strands so secured, and not solely by the upsets on their ends.

BACKGROUND OF THE INVENTION

It is known to employ plastic hemisphere receptacles to hold and display plants and the like, while being suspended from a rafter or ceiling by wires or ropes attached to the rim of the receptacle. It is known in the above system of hanging displays that the ropes and/or wires are difficult to adjust to give variety of distance from the ceiling and to maintain the rim of the receptacle level. The wires and ropes are attached to apertures in the rim of the receptacle which when formed or bored into the rim creates a point of weakness in the wall. The most common source of failure in the known plastic receptacle is the cracking of the wall due to the creeping of a break caused at the rim made during installation of the hangers.

Another disadvantage of known hanging devices is that the wires and ropes used therein to suspend them obstruct the view of the contents of the device being displayed therefrom. Where the known devices using ropes such as macrame, are used to suspend a display over a counter, the ropes obstruct the view of the clerk across the counter and of a patron in a commercial establishment, of the goods and clerk behind the counter. It has been recognized that in retail trades, a display device that does not obstruct the clerk's view or the patron's view is needed for hanging above a counter to display wares for sale at close tempting view of the patron.

An object of the invention is to provide a suspended display receptacle that is preferably made of clear plastics material and which is preferably suspended by fine clear hangers that allow full view of the contents of the receptacle.

It is another object of the invention to provide a plurality of filament or strand fastening tabulate or protrusion bodies on the rim of the receptacle which do not damage the wall of the receptacle during installation and which bear the weight of the whole across a broad surface rather than at a point contact to thereby protect the filament or strand from end of strand failure.

A further object of the invention is to provide in one embodiment for the securing of the filament strands together in a melded joint at a common upper end with all filaments or strands of equal length and of providing a device between said common point and the ceiling suspension point to allow adjustment of height of the strands in common.

Further and other objects of the invention will be realized by those skilled in the art from the following summary of the invention and detailed description thereof.

SUMMARY OF THE INVENTION

The above objects are achieved by the provision of a display receptacle (for example a planter) carrying a plurality of tabulate bodies or relatively thin protrusions preferably equally spaced on a surface of the display receptacle (for example, planter) proximate the rim thereof, each tabulate body or relatively thin protrusion presenting a face on the side of the body remote the surface of the receptacle and presenting a slot intermediate the body's or protrusion's width opening through the face along its length (preferably partially covered by a wall restricting its opening through the face) from the top of the protrusion and extending downwardly (preferably opening through the bottom of the tabulate body or protrusion) the slot carrying a wider slot portion or socket at the upper end thereof also opening through the face of the wider slot portion or socket, (preferably also presenting a wall restricting the opening through the face to less than the width of the socket and preferably to the same width as the opening to the slot through the face), the tabulate body or protrusion carrying another channel slot or groove (preferably a circumferential groove around the periphery of the tabulate body) into which the first mentioned slot opens, and which channel, slot or groove extends in a curved path (curvilinearly) to the top of the body or protrusion at a position spaced from the wider slot portion or socket, the channel, slot or groove comprising means for restricting a portion of the opening of the channel, slot or groove, to require flexure of the filament strand when it is pushed into the channel, slot or groove to thereby allow the strand to seat and be held in the channel, slot or groove during use in suspension of the receptacle. Preferably at least three horizontally coplanar spaced points proximate its rim are provided with tabulate bodies or protrusions for supporting filaments or strands, preferably of extruded monofilament polypropylene, all of uniform length and connected to each other at their upper ends. Upsets or enlarged ends are integrally provided in the material of each filament at the lower ends of each strand to lock into the socket or wider slot portion with the strand carried in the slot. In this regard, the opening through the face to the slot is slightly less than the thickness of the strand but the wall portion, flange, or bead reducing the opening of the slot though the face is flexible enough to permit the strand material to pass thereinto.

According to another aspect of the invention, the tabulate body or protrusion has a bead or flange around at least one side and its base, forming a space between it and the outer wall of the receptacle and providing a surface groove on the said side and base of the lock for receiving the downwardly and upwardly gathered strand which by the wrapping around the lower part or base of the lock reduces the tensile stress on the upset secured in the socket which could part the upset from the strand.

The upper ends of the filaments may be melded together after each has been passed through an aperture or eye in a suspension ring to thereby allow the multi-stranded suspension to be adjusted at any common point and then held by the suspension ring at said point which is equidistant from the receptacle rim, the strands being fixed in the chosen length by knotting them together adjacent the upper side of the aperture.

According to another aspect of the invention, a display receptacle is provided having a rim and an outer surface and carrying a plurality of tabulate bodies or relatively thin protrusions, each tabulate body or relatively thin protrusion presenting a face on the side of the body remote the surface of the receptacle, proximate its rim, carrying a socket and vertically extending slot, both opening through the face, a wall restricting the opening of the socket and slot through the face to less than their widths, the slot extending to a groove around the body having restricted groove portions so that a filament strand with an enlarged end secured in the socket and passing down the slot and around the tabulate body in the groove is secured to the tabulate body or protrusion in cradle fashion to reduce the tensile stress on the enlarged end.

The strands from each body may then be passed together through an aperture in a hanger ring and melded together to rest on the rim of the aperture on the ring. The strands may also be equally adjusted for length from the rim of the receptacle by knotting them together at any desired position above the aperture in the ring.

According to another aspect of the invention, a display receptacle to be suspended by fine extruded monofilament strands of material is provided, the strands to be held to the rim of the receptacle by upsets formed in the end of each strand which each seat in a socket integrally formed in a tabulate body or protrusion provided at the rim of the receptacle, the strands extending through a slot in the tabulate body opening through the face of the body and extending down through the body away from the rim and opening through the tabulate body, the filament being held around the body, to cradle the strands and ensure that the tension of the suspension is borne by the strands and not solely by the upsets on their ends.

According to another aspect of the invention, a suspendable display receptacle is provided comprising in combination, a display receptacle suspended at, at least three equidistant horizontally coplanar spaced points, a plurality of supporting strands of uniform length connected to each others' upper end, upsets integral with the material of said strands at the lower ends of said strands; tabulate bodies on said receptacle at said spaced points for securing said upsets thereto so as to reduce tensile stress tending to part said upsets from said strands, said tabulate bodies each for securing said upsets and comprising a cental portion secured against said receptacle at or in the vicinity of the rim of said receptacle, a bead projecting from and extending curvilinearly around at, at least one side and a base portion of said body and being also spaced from said receptacle, said tabulate body also including a socket for said upset and a slot for receiving the strand which extends downwardly into the channel, slot or groove extending between the bead and surface of the display unit, the socket and slot each opening through the face of the tabulate body remote the display receptacle, a portion of said strand being receivable against the slight outward flexure of at least a portion of said bead under lateral pressure upon said strand to permit the strand to pass into the space between said bead and said receptacle; and means for collecting the strands to any desired common point equidistant from said receptacle.

According to another aspect of the invention, the portion of said bead comprises at least said upper ends of said bead thickened so as to reduce the space between said upper end and said receptacle to facilitate the insertion and retention of said strand into an elongated groove formed between said bead and said receptacle.

BRIEF DESCRIPTION OF THE DRAWINGS

With the foregoing in view and such other objects and novel features that become apparent from consideration of this disclosure, the present invention consists of the inventive concept which is comprised, embodied and included in the construction method or combination of parts herein exemplified, reference being had to the accompanying drawings in which like reference numerals refer to like parts.

FIG. 1 is a view of the display receptacle shown suspended by three strands from a ring and shows in exploded form the means of passing the strands together through the ring and adjusting the height of the suspension strands by knotting them together above an aperture in the ring.

FIG. 2 is a close-up view of one strand lock means (tabulate body or protrusion) integrally formed proximate the rim of the receptacle, and shows a strand having an enlarged end (bead) taken from the body to show the manner of wrapping the strand.

FIG. 3 is a sectional view of parts of two mating receptacles to show how pairs of lock means can be positioned adjacent one another to provide a means for holding the two receptacles together by means of a pair of strands secured to the locks and gathered together by a bead.

FIG. 4 is a view of the mating receptacles and their locks showing an alternative means of holding them together, namely a clip member yoked over both lock means.

DETAILED DESCRIPTION OF THE DRAWINGS

Numeral 10 of FIG. 1 indicates an embodiment of the invention comprising a pair of clear plastic receptacles 12, 13, (see FIG. 4) shown suspended by three strands of polypropylene, 14, 15, 16, from ring 55. Strand locking means or tabulate bodies or protrusions 17, 18, 19 are formed integrally with the receptacle 12 and are equally spaced proximate the rim, to each receive the strands 14, 15, 16, respectively. The upper receptacle 13 can be omitted from the display except where a cover for the lower receptacle 12 is desired.

Receptacle 13 is shown merely resting on receptacle 12 with the ingathering of filament strands 14, 15, 16 by a common bead 48 tending to hold them together as a single covered display. Where a more secure means is required for holding the two hemispheres together is required, the filament locking means (tabulate bodies or protrusions) of each can be mated as shown in FIGS. 3 and 4 with means for securing the locks together. In FIG. 3 a pair of filaments 20, 22 have their upsets secured at 24 by fitting into a socket shown in FIG. 2 as numeral 40, of the lower lock means (protrusion or tabulate body) 18. The filaments are then passed around the outer beaded and flanged sides of the lower lock 18, one strand 20 to one side 36 and the other strand 22 to the other side 36*a*. Strand 20 is then passed into the space between the bead of one side of lock 30 on the upper receptacle 13 enumerated in the FIG. 3 as 27, and strand 22 is passed into the space 27*a* on the other side of the upper lock means 30. The strands can then be gathered together by a common bead 33 having an aperture therethrough 32 into which both strands 20, 22 can be fitted to allow bead 33 to travel freely along them to tighten the strands in the lock 30 or to allow the top receptacle 13 to be freed from 12.

The alternative means of securing a pair of mating locks 18, 30 is shown in FIG. 4 where a simple clip means 58 with flanged edges is fitted over the locks 18, 30 with the flanges of the clip 58 gripping the flanged beads of their sides to thereby provide a yoke means for the pair of locks of the strand securing means of the receptacles.

An enlarged view of the locking cradle (protrusion or tabulate body) 18 of the lower receptacle 12 is shown in FIG. 2 with the strand 15 shown taken from its hold position in the socket 40, slot 41, and the space formed by bead flange 36*a*. Tabulate body 18 is integrally moulded to the outer wall on the outer surface of the receptacle 12 proximate rim 35. Tabulate body 18 presents a face on the side of body 18 remote the surface of the receptacle, a slotted groove (slot) 41 intermediate its width from proximate the top extending downwardly and opening through the bottom and through the face of the protrusion. Slot 41 carries a wider slot portion or socket 40 at the upper end of the slot in communication with the slot. Both slot 41 and socket 40 open through the face. Each such opening is covered by a wall to provide a restricted opening. Slotted groove 41 at its lower end communicates with slots 37 which are created by the beads 36, 36*a* of protrusion or body 18. Beads 36, 36*a* are flanged bead portions and project curvilinearly around the tabulate body 18, sides and base, to create slots 37 between receptacle 12 and the beads 36, 36*a*. Socket 40 is provided in the upper side of the cradle 18 to receive the enlarged end (upset) 47 formed on the end of each filament 15. Slotted groove 41, formed downwardly from the socket 40, and slot 37 around tabulate body, are provided to receive filament 15 and cradle filament 15 to reduce the tensile stress on the enlarged end (upset). To this end, walls or beads 36, 36*a* are each enlarged inwardly at upper corners 44, 45 of the tabulate body 18, to reduce the space between the bead and the receptacle outer wall to require flexure of the bead at those locations by the pressure of the filament strand 15 when it is pushed into the space to thereby allow the strand to seat and be held in the space (channel, slot or groove) during use in suspension of the receptacle. The thickened bead at 44, 45 assists in maintaining the strand in its position around the body 18 thereby maintaining even tensile pressure on the strand as it is cradled in the slots 37 formed by the beads 36, 36*a*.

In suspending the display receptacle, the upsets of each of three strands 14, 15, 16 can be first set into the sockets of their three respective cradle locks 17, 18, 19 and the strands pulled down between the beads on the sides of the cradle and the wall of the receptacle and forced into slots 44 through the opening in the face and around the body in slot 37 and then the strands are gathered up together and threaded through an aperture in bead 48 to become thereafter a common multi-strand suspender which is then threaded through aperture 50 in a holding ring 55 after which the ends are melded together to create a unit having equal distance between the rim of the receptacle. The melded end is numbered 60.

The aperture or eye 50 in ring 55 serves to allow the multistrand suspension means to be adjustable to locate the receptacle thereto at a specific required level. This is done by knotting the strands together at any desired location 57 above the ring where it binds to be held by the ring.

Where heavy loads are to be used in the receptacle, such as earth for a terrarium, pairs of strands as shown in FIG. 3 are used and the socket 40 is enlarged to seat the two upsets.

Where it is desired to have the upper receptacle 13 removeably suspendable above receptacle 12 while the contents of 12 are being examined, removed or replaced for example, a ring means and filament strand (not shown) could be attached to the top of the receptacle 13 for temporary lifting of the receptacle. The filament could be attached to ring 55.

Where it is desired by the user to be able to display and arrange a plant having cascading foliage without having the hangers obstructing his freedom to work with the receptacle or where it is desired to package and transport the receptacles in nesting mode and the hangers in separate mode the hangers can be gathered together on the ring prior to their installation on the locks. The strands are each made of equal length and the upsets formed on their ends. The three free ends are first passed through the gathering bead (when used) and then passed together through the ring aperture. The three (or more) free ends are melded together to provide a hanger each strand of which is equal in length. The ring will prevent the strands from pulling through by holding the meld against the rim. After the user has filled the receptacle the upsets are fitted to their cradle locks and the combination of receptacle and hangers hung to a suitable hook from the rafter. With the melded ends held on the rim of the ring the user can adjust the distance of the receptacle from the hooked ring by pulling up the strands through the aperture in the ring and tying them together in a knot to seat on the ring rim at the desired height.

As many changes can be made to the embodiment without departing from the scope of the invention, it is intended that all matter contained herein shall be interpreted as illustrative of the invention and not in a limiting sense.

The embodiments of the invention in which an exclusive property or privilege is claimed are as follows:

1. A display receptacle carrying a plurality of tabulate bodies or relatively thin projections on a surface of the display receptacle proximate the rim thereof for securing strands having enlarged ends, each tabulate body or relatively thin protrusion presenting a face on the side of the body remote the surface of the receptacle and presenting a slot, intermediate the body's or protrusion's width, opening through the face along its length from the top of the protrusion and extending downwardly, the slot carrying a wider slot portion or socket at the upper end thereof also opening through the face, each tabulate body or protrusion carrying another channel, slot or groove into which the first mentioned slot opens and which channel, slot or groove extends in a curved path to the top of the body or protrusion at a position spaced from the wider slot Portion or socket, the channel, slot, or groove comprising means for restricting a portion of the opening of the channel, slot or groove, to require flexture of a filament strand when it is pushed into the channel, slot or groove to thereby allow the strand to seat and be held in the channel, slot or groove during use in the suspension of the receptacle.

2. The display of claim 1 wherein each display receptacle is a planter.

3. The display receptacle of claim 1 wherein the face of the tabulate body through which the first slot opens, presents a wall which restricts the opening of the slot through the face.

4. The display receptacle of claim 3 wherein the face of the tabulate body also presents a wall restricting the opening through the face of the wider slot portion or socket.

5. The display receptacle of claim 4 wherein the width of the opening of the wider slot portion, and the slot, through the face are equal.

6. The display receptacle of claim 1 wherein the channel, slot or groove comprises a circumferential groove around the periphery of the tabulate body into which the first slot opens and the means for restricting the opening of the channel, slot or groove comprises enlarged inwardly directed means to reduce the space of the channel, slot or groove to require flexure thereof when the strand is pushed into the space of the channel, slot or groove to allow the strand to seat and be held in the channel, slot or groove during use in suspension of the receptacle.

7. The display receptacle of claim 3 wherein the channel, slot or groove comprises a circumferential groove around the periphery of the tabulate body into which the first slot opens and the means for restricting the opening of the channel, slot or groove comprises enlarged inwardly directed means to reduce the space of the channel, slot or groove to require flexure thereof when the strand is pushed into the space of the channel, slot or groove to allow the strand to seat and be held in the channel, slot or groove during use in suspension of the receptacle.

8. The display receptacle of claim 4 wherein the channel, slot or groove comprises a circumferential groove around the periphery of the tabulate body into which the first slot opens and the means for restricting the opening of the channel, slot or groove comprises enlarged inwardly directed means to reduce the space of the channel, slot or groove to require flexure thereof when the strand is pushed into the space of the channel, slot or groove to allow the strand to seat and be held in the channel, slot or groove during use in suspension of the receptacle.

9. The display receptacle of claim 5 wherein the channel, slot or groove comprises a circumferential groove around the periphery of the tabulate body into which the first slot opens and the means for restricting the opening of the channel, slot or groove comprises enlarged inwardly directed means to reduce the space of the channel, slot or groove to require flexure thereof when the strand is pushed into the space of the channel, slot or groove to allow the strand to seat and be held in the channel, slot or groove during use in suspension of the receptacle.

10. The display receptacle of claim 1 wherein the plurality of tabulate bodies number at least three, and are equally spaced about the rim.

11. A display receptacle to be suspended by fine extruded monofilament strands of material, the strands to be held to the rim of the receptacle by upsets formed in the end of each strand which each seat in a socket integrally formed in a tabulate body or protrusion provided at the rim of the receptacle, the strands extending through a slot in the tabulate body opening through the face of the body and extending down through the body away from the rim and opening through the tabulate body, the filament being held around the body, to cradle the strands and ensure that the tension of the suspension is borne by the strands and not solely by the upsets on their ends.

12. A suspendable display receptacle comprising in combination, a display receptacle suspended at, at least three equidistant horizontally coplanar spaced points, a plurality of supporting strands of uniform length connected to each others' upper ends, upsets integral with the material of said strands at the lower ends of said strands; tabulate bodies on said receptacle at said spaced points for securing said upsets thereto so as to reduce tensile stress tending to part said upsets from said strands, said tabulate bodies each for securing said upsets and comprising a central portion secured against said receptacle at or in the vicinity of the rim of said receptacle, a bead projecting from and extending curvilinearly around at, at least one side and a base portion of said body and being also spaced from said receptacle, said tabulate body also including a socket for said upset and a slot for receiving the strand which extends downwardly into the channel, slot or groove extending between the bead and surface of the display unit, the socket and slot each opening through the face of the tabulate body remote the display receptacle, a portion of said strand being receivable against the slight outward flexure of at least a portion of said bead under lateral pressure upon said strand to permit the strand to pass into the space between said bead and said receptacle; and means for collecting the strands to any desired common point equidistant from said receptacle.

13. The display receptacle according to claim 12, in which the portion of said bead comprises at least the upper ends of said bead, thickened so as to reduce the space between said upper end and said receptacle to facilitate the insertion and retention of said strand into an elongated groove formed between said bead and said receptacle.

14. A display receptacle having a rim and an outer surface and carrying a plurality of tabulate bodies or relatively thin protrusions. each tabulate body or relatively thin protrusion presenting a face on the side of the body remote the surface of the receptacle, proximate its rim, carrying a socket and vertically extending slot, both opening through the face, a wall restricting the opening of the socket and slot through the face to less than their widths, the slot extending to a groove around the body having restricted groove portions so that a filament strand with an enlarged end secured in the socket and passing down the slot and around the tabulate body in the groove is secured to the tabulate body or protrusion in cradle fashion to reduce the tensile stress on the enlarged end.

15. The display receptacle of claim 14, further comprising filament strands, one for each tabulate body, passed together through an aperture in a hanger ring and melded together to seat on the rim of an aperture on the ring.

* * * * *